US006959706B2

(12) United States Patent
Brandt

(10) Patent No.: US 6,959,706 B2
(45) Date of Patent: Nov. 1, 2005

(54) SAFETY CIRCUIT FOR CHIMNEY FANS

(75) Inventor: Henning Brandt, Odense (DK)

(73) Assignee: Exhausto A/S, Langeskov (DK)

( * ) Notice: Subject to any disclaimer, the term of this patent is extended or adjusted under 35 U.S.C. 154(b) by 0 days.

(21) Appl. No.: 10/693,342

(22) Filed: Oct. 24, 2003

(65) Prior Publication Data

US 2004/0112370 A1 Jun. 17, 2004

(30) Foreign Application Priority Data

Dec. 12, 2002 (DK) ..... 2002 01906

(51) Int. Cl.[7] ..... F24B 13/00
(52) U.S. Cl. ..... 126/299 R
(58) Field of Search ..... 126/299 R, 307 R, 126/312, 500; 454/255; 73/705, 715; 310/71

(56) References Cited

U.S. PATENT DOCUMENTS 3,643,624 A * 2/1972 Eng et al. ..... 116/137 A
4,181,099 A * 1/1980 Binstock ..... 122/448.1
4,204,832 A * 5/1980 Miller ..... 431/20
4,250,868 A * 2/1981 Frye ..... 126/502
5,513,979 A 5/1996 Pallek et al.
5,555,876 A * 9/1996 Francisco et al. ..... 126/504
5,568,691 A * 10/1996 Rubin ..... 34/98
6,205,405 B1 * 3/2001 Pouvreau ..... 702/41
6,250,133 B1 * 6/2001 Schell ..... 73/23.31
6,456,024 B1 * 9/2002 Schmider et al. ..... 318/254

FOREIGN PATENT DOCUMENTS

DE 101 59 033 9/2002

* cited by examiner

*Primary Examiner*—Stephen Gravini
(74) *Attorney, Agent, or Firm*—Pearne & Gordon LLP

(57) ABSTRACT

A single-phase asynchronous motor with an auxiliary winding in which non-rotation is detected by the absence of an induced voltage across the auxiliary winding when it is briefly disconnected from its power source. Before the detection, the motor is briefly provided with a higher operating voltage.

12 Claims, 1 Drawing Sheet

SAFETY CIRCUIT FOR CHIMNEY FANS

BACKGROUND OF THE INVENTION

The invention relates to a safety circuit for a household current powered chimney fan, which generates a signal when the ventilator fails to rotate.

In order to prevent a smoke downdraft and in order to improve the draft in general in a furnace chimney, fans or smoke extractors are used. In conjunction with the extraction of flue gases, especially from an open fireplace, safe combustion may be dependent on the ventilator actually turning and exhausting the gases. A natural draft that occurs when the ventilator does not rotate is not always sufficient, especially with fuel having a high moisture content. There may be several reasons for the lack of rotation, for instance an overheating safety fuse in the motor may have cut out, or the motor circuit may be dead for other reasons. Finally, a blockage may occur after extended use due to deposits of soot, ash, and tar, which occur most frequently when the fuel is not dry. Furthermore, a strong frost may cause condensed water to freeze preventing restarting of the motor after an intended stoppage.

It is known to provide alarms for indicating when a ventilator of the above-mentioned type fails to rotate. They are most frequently based on a magnetic detection, e.g. by means of a Hall element and a magnet fitted to the shaft of the ventilator. In U.S. Pat. No. 5,513,979 one such alarm for a DC motor is described. However, due to its simple construction, a chimney fan is preferably used with a single-phased asynchronous motor supplied by household current of the type using an auxiliary winding with a capacitor. Furthermore, a Hall element-based detection of movement may fail. See, for example, DE 101 59 033, which describes an alarm that provides an "emergency function", i.e. a minimal regulation within a safe range, in case the rotation information from the Hall element is not received.

Thus, there is a need for a robust solution to the described problem, which may also form the basis for a differentiated display of a cause for the lack of rotation.

BRIEF SUMMARY OF THE INVENTION

According to the invention, voltage supplied to a motor is briefly increased immediately before a short interruption of the connection between the household current and the capacitor is performed. During the interruption a measuring signal is taken across the auxiliary winding and an alarm is tripped if the measuring signal is below a predefined value. The increased speed may be obtained by briefly supplying the motor with the maximum operating voltage. This helps to assure that the measured voltage will be high enough for a secure detection, even though the smoke extractor may be adjusted to a minimum speed. Also, mild blockages that often occur at a low speed settings may be overcome due to the increased torque.

The safety circuit may be combined with a speed control of the smoke ventilator, e.g. a phase-controlled SCR reduction of the power supplied. In such an embodiment of the invention, the speed control is briefly set to maximum before the brief interruption for obtaining the measurement signal. Thus, a separate special circuit for supplying the motor with the full voltage is not necessary.

Further, during an alarm, information on the availability of the household current supply may be combined with information on the continuity of current in the motor circuit in order to determine whether a blockage of the shaft is present. In this way it is possible to provide a differentiated alarm that includes diagnosis information.

BRIEF DESCRIPTION OF THE DRAWING

The invention will be further described in conjunction with the drawing, in which.

DETAILED DESCRIPTION OF THE INVENTION

Figure 1:
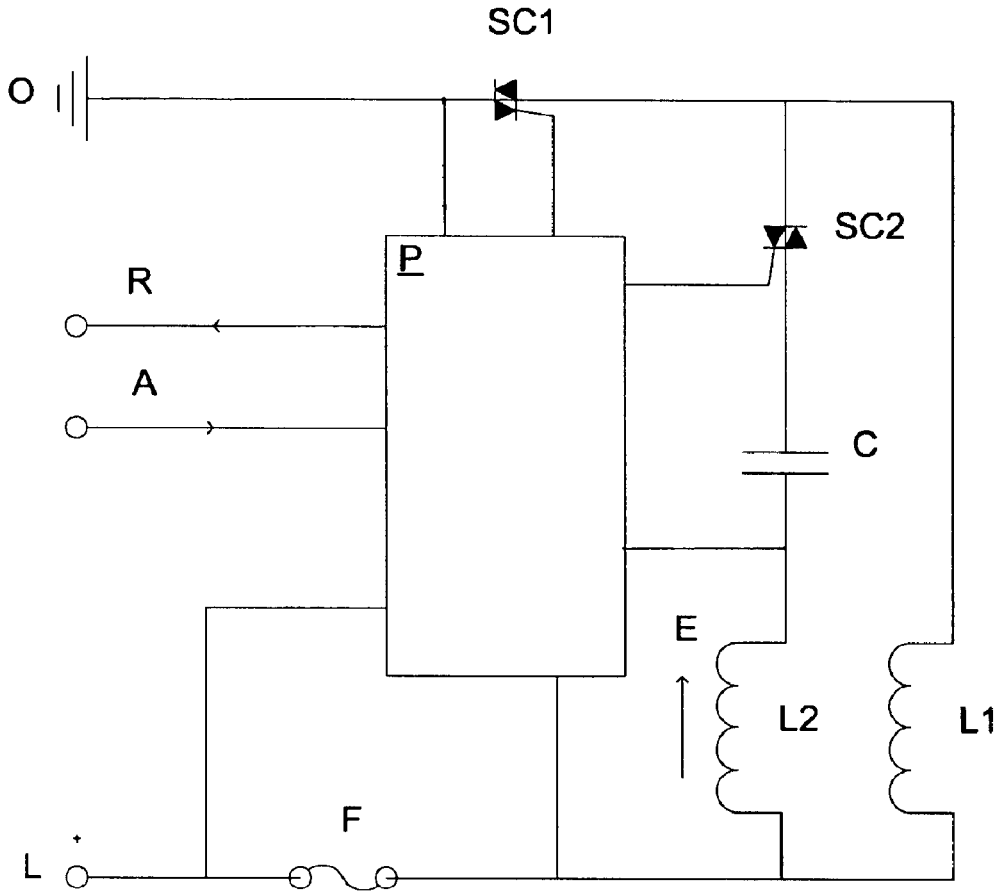
FIG. 1 shows a circuit according to an embodiment of the invention.

FIG. 1 shows a safety circuit including two windings L1, L2 in a single-phase asynchronous motor, with a capacitor C for the auxiliary winding, connected to a household current supply via a phase delay power controller SC1 in series with the motor. The various elements for time control and measurement are parts of a control unit P, which is powered by the household current and with a battery backup. The motor and ventilator wheel are normally fitted up high in the flue, e.g. at the top of the chimney, and the control unit P for speed regulation would be fitted close to the fireplace and e.g. connected by means of a cable for which a signal is available at the terminal R. Alternatively, the communication between the control unit P and the motor may be wireless. A thermal overload fuse F is connected in series with the hot wire of the motor. During normal operation the auxiliary winding L2 is connected in series with the capacitor C and the series connection is connected in parallel to the main winding L1. The entire series-parallel connection of the windings L1, L2 and the capacitor is connected in series with the semiconductor component SC1, which may be controlled in a suitable range by means of the control unit P. A minimum value is set such that rotation is ensured. A maximum value may be set so that full motor current is obtained at the operating voltage, but may also be set to a lower value.

The safety circuit is activated at the start of operation of the chimney fan and at every minute thereafter. When the safety circuit is activated, the following operation steps are performed in sequence:

a) providing the full household voltage across the motor for ½ second by means of the control unit P and the semiconductor component SC1, b) disconnecting the capacitor C from ground O by means of the control unit P and the semiconductor component SC2, c) waiting for ⅙ second for transients in the auxiliary winding L2 to subside, d) taking a measurement across the auxiliary winding for 1/20 second, e) reconnecting the auxiliary winding by means of SC2, and f) reconnecting the preset operational voltage by means of SC1.

The measurement includes rectification and smoothing of an induced voltage E measured across the winding L2. If the value obtained by the measurement is related in a predetermined way to a set value, an alarm condition is activated. The alarm condition is indicated on a display of the speed control unit, but it may be used in other ways. The alarm signal is available on terminal A. For the sake of simplicity, noise-reducing components, such as induction coils or capacitors, are not shown in the circuit diagram.

Asynchronous motors can be speed-controlled, either on both windings or on the main winding only. The safety circuit of the present invention may be adapted for use with both modes of operation.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A safety circuit for a chimney fan driven by a household current-powered asynchronous motor with an auxiliary winding and a capacitor, comprising:

means for briefly increasing a supply of voltage to the motor immediately before a brief interruption of the connection between the household current and the capacitor;

means for measuring a signal across the auxiliary winding, and means for causing an alarm indication when the signal is below a preset value.

2. A safety circuit according to claim 1, wherein the means for briefly increasing is performed in conjunction with an electronic speed control for the motor by briefly setting the speed control to maximum.

3. A safety circuit according to claim 1, further comprising means for combining information about the presence of household voltage with information about a current in the motor circuit in order to ascertain if a blocked motor shaft has occurred when the alarm is indicated.

4. A safety device for a chimney fan driven by a household current-powered asynchronous motor with an auxiliary winding and a capacitor, the safety device comprising:

a safety circuit, wherein a voltage supplied to the motor is briefly increased immediately before a brief interruption of the connection between the household current and the capacitor, whereupon a measuring signal is taken across the auxiliary winding, said measuring signal causing an alarm when it is below a preset value.

5. A safety circuit according to claim 4 in conjunction with an electronic speed control for the motor, wherein the speed control is briefly set to maximum immediately before the brief disconnection in order to obtain the measuring signal.

6. A safety circuit according to claim 4, wherein in case of alarm, information about the presence of household voltage is combined with information about a current in the motor circuit in order to ascertain if a blocked motor shaft has occurred.

7. Method for monitoring a chimney fan driven by a household current-powered asynchronous motor with an auxiliary winding and a capacitor, comprising steps of:

briefly increasing a voltage supplied to the motor;

immediately after the step of increasing, briefly interrupting a connection between the household current and the capacitor;

measuring a signal across the auxiliary winding during the brief interruption; and causing an alarm indication when the signal is below a preset value.

8. The method of claim 7, wherein the step of briefly increasing the voltage is performed in conjunction with an electronic speed control for the motor by briefly setting the speed control to a maximum level.

9. The method of claim 7, further comprising a step of combining information about the presence of household voltage with information about a current in the motor circuit in order to ascertain if a blocked motor shaft has occurred when the alarm is indicated.

10. A chimney fan system comprising:

a safety circuit; and a chimney fan driven by a household current-powered asynchronous motor with an auxiliary winding and a capacitor;

wherein the voltage supplied to the motor is briefly increased immediately before a brief interruption of the connection between the household current and the capacitor, whereupon a measuring signal is taken across the auxiliary winding, said measuring signal causing an alarm indication when it is below a preset value.

11. The chimney fan system of claim 10 further comprising an electronic speed control for the motor, wherein the speed control is briefly set to maximum immediately before the brief disconnection in order to obtain the measuring signal.

12. The chimney fan system of claim 10, wherein in when the alarm is indicated, information about the presence of household voltage is combined with information about a current in the motor circuit in order to ascertain if a blocked motor shaft has occurred.

* * * * *